US011560709B2

(12) United States Patent
Hatzinikolas

(10) Patent No.: US 11,560,709 B2
(45) Date of Patent: Jan. 24, 2023

(54) SUPPORT BRACKET HANGER ASSEMBLY AND METHOD

(71) Applicant: FERO CORPORATION, Edmonton (CA)

(72) Inventor: Michael Hatzinikolas, Edmonton (CA)

(73) Assignee: Fero Corporation, Edmonton (CA)

( * ) Notice: Subject to any disclaimer, the term of this patent is extended or adjusted under 35 U.S.C. 154(b) by 0 days.

(21) Appl. No.: 17/346,119

(22) Filed: Jun. 11, 2021

(65) Prior Publication Data

US 2022/0396948 A1 Dec. 15, 2022

(51) Int. Cl.

| | |
|---|---|
| ***E04F 13/14*** | (2006.01) |
| ***E04F 13/25*** | (2006.01) |
| ***E04B 2/06*** | (2006.01) |
| ***E04B 1/41*** | (2006.01) |
| ***E04F 13/08*** | (2006.01) |

(52) U.S. Cl.

CPC ..... *E04B 1/4178* (2013.01); *E04B 2/06* (2013.01); *E04F 13/0801* (2013.01); *E04F 13/25* (2013.01); *E04F 13/0862* (2013.01); *E04F 13/14* (2013.01); *E04F 13/147* (2013.01)

(58) Field of Classification Search

CPC ..... E04B 1/4178; E04B 2/06; E04B 1/7616; E04B 2002/565; E04B 13/0853; E04B 2001/405; E04B 2002/7481; E04B 1/7046; E04F 13/0801; E04F 13/25; E04F 13/14; E04F 13/147; E04F 13/0857; E04F 13/26; E04F 13/08505; E04F 13/0862; E04F 13/09; E04C 2003/023

See application file for complete search history.

(56) References Cited

U.S. PATENT DOCUMENTS

| | | | | |
|---|---|---|---|---|
| 1,455,712 A | | 5/1923 | Collins | |
| 1,697,003 A | | 1/1929 | Fink | |
| 1,729,935 A | | 10/1929 | Froehlich | |
| 1,764,134 A | | 6/1930 | Young et al. | |
| 1,864,965 A | * | 6/1932 | Venzie | E04B 9/24 52/506.08 |

(Continued)

FOREIGN PATENT DOCUMENTS

| | | | | |
|---|---|---|---|---|
| CA | 2426567 A1 | * | 2/2004 | E04C 3/02 |
| CA | 2526876 A | | 2/2006 | |

(Continued)

OTHER PUBLICATIONS

International Search Report & Written Opinion dated Mar. 12, 2020 for PCT/CA2019/051727.

*Primary Examiner* — Phi D A

(74) *Attorney, Agent, or Firm* — Ridout & Maybee LLP

(57) ABSTRACT

A masonry veneer support assembly for mounting masonry veneer to supporting wall structure has a shelf angle, and first and second shelf angle mounting brackets. Each shelf angle mounting bracket has an upwardly extending back that mounts to the supporting wall structure, and a web extending forwardly away from the wall structure. The web has first and second shelf angle mounting seats formed therein. The first shelf angle mounting seat is upwardly spaced from the second shelf angle mounting seat. Hangers in the form of two-part separable brackets are provided to permit masonry veneer to be mounted underneath the shelf angle, thereby concealing it from view.

16 Claims, 6 Drawing Sheets

(56) References Cited

U.S. PATENT DOCUMENTS 2,363,156 A 6/1943 Sinner et al.
2,586,327 A * 2/1952 Haertel ..... E04B 9/16 52/506.09
3,050,160 A 8/1962 Chesser et al.
3,234,702 A 2/1966 Zibell
3,341,909 A 9/1967 Havener
3,414,224 A 12/1968 Robbiliard et al.
3,450,427 A 6/1969 Fischer et al.
3,666,303 A 5/1972 Huls
3,680,271 A 8/1972 Satchell
3,730,466 A 5/1973 Swanquist
3,942,292 A 3/1976 Robinson
4,013,253 A 3/1977 Perrault et al.
4,094,415 A 6/1978 Larson
4,373,314 A * 2/1983 Allan ..... E04B 1/7616 52/379
4,390,103 A 6/1983 Husband
4,422,610 A 12/1983 Hunt
4,429,850 A 2/1984 Weber et al.
4,447,961 A 5/1984 Valat
4,515,494 A 5/1985 Robilliard et al.
4,805,364 A 2/1989 Smolik
4,805,367 A 2/1989 Smolik
4,827,684 A 5/1989 Allan
4,869,043 A 9/1989 Hatzinikolas et al.
4,922,680 A * 5/1990 Kramer ..... E04B 1/4185 52/713
D311,858 S 11/1990 Richmond
5,018,323 A 5/1991 Clausen
5,035,099 A 7/1991 Lapish
5,063,715 A 11/1991 Goodman
5,082,388 A 1/1992 Lauterbach
5,265,396 A 11/1993 Amimoto
5,313,752 A 5/1994 Hatzinikolas
5,392,581 A 2/1995 Hatzinikolas et al.
5,405,116 A 4/1995 Shepherd et al.
5,456,435 A 10/1995 Sweeney
5,588,537 A 12/1996 Hagopian
5,619,734 A 4/1997 Chen
5,619,834 A 4/1997 Chen
5,671,578 A * 9/1997 Hohmann ..... E04B 1/7616 52/562
5,720,460 A * 2/1998 Watson ..... E04F 13/0816 52/712
5,794,902 A 8/1998 Henry et al.
5,816,008 A * 10/1998 Hohmann ..... E04B 1/4178 52/565
6,098,942 A 8/2000 Heath
6,128,883 A 10/2000 Hatzinikolas
6,161,709 A 12/2000 Kluge et al.
6,209,281 B1 * 4/2001 Rice ..... E04B 1/4178 52/379
6,298,620 B1 10/2001 Hatzinikolas
6,584,741 B1 7/2003 Hatzinikolas
6,817,688 B2 11/2004 O'Halloran
6,973,756 B2 12/2005 Hatzinikolas
7,367,165 B2 5/2008 Hatzinikolas
7,392,911 B2 7/2008 Stitchick et al.
7,415,803 B2 8/2008 Bronner
7,469,511 B2 * 12/2008 Wobber ..... E04B 1/4178 52/354
7,469,659 B2 12/2008 de Jonge et al.
7,614,590 B2 11/2009 Boville
7,654,058 B2 2/2010 Hatzinikolas
7,765,771 B2 8/2010 Serpico et al.
7,908,804 B2 3/2011 Vieira
3,051,621 A1 11/2011 Hatzinikolas
8,250,827 B2 8/2012 Lin et al.
8,333,048 B2 12/2012 Talpe
8,490,340 B2 7/2013 Hatzinikolas
8,490,341 B2 7/2013 Hatzinikolas
8,555,595 B2 10/2013 Hatzinikolas
8,621,802 B2 * 1/2014 Spyrou ..... E04B 2/56 52/489.1
8,667,763 B2 3/2014 Hatzinikolas
8,739,485 B2 * 6/2014 Hohmann, Jr. ..... E04B 1/4178 52/513
8,893,452 B2 * 11/2014 Hatzinikolas ..... E04B 2/00 52/712
8,904,730 B2 * 12/2014 Hohmann, Jr. ..... E04B 1/4178 52/379
8,955,263 B2 2/2015 Hatzinikolas
9,010,050 B2 4/2015 Hatzinikolas
9,010,062 B2 4/2015 Hill
9,027,301 B2 5/2015 Guinn
9,121,169 B2 * 9/2015 Hohmann, Jr. ..... E04B 1/7637
9,316,004 B1 4/2016 Hatzinikolas
9,334,646 B2 * 5/2016 Hohmann, Jr. ..... E04B 1/4185
9,447,585 B2 9/2016 Hatzinikolas
9,856,655 B2 * 1/2018 Knight ..... E04F 13/0807
10,294,676 B2 5/2019 Hatzinikolas
10,323,419 B2 6/2019 Hatzinikolas
10,443,239 B2 * 10/2019 Hohmann, Jr. ..... E04C 3/02
11,041,315 B2 6/2021 Hatzinikolas
11,078,672 B2 8/2021 Hatzinikolas
11,118,358 B2 9/2021 Hatzinikolas
11,162,265 B2 11/2021 Hatzinikolas
11,255,091 B2 2/2022 Hatzinikolas
2006/0272251 A1 12/2006 Hatzinikolas
2008/0092472 A1 * 4/2008 Doerr ..... E04B 1/4178 52/379
2010/0287864 A1 11/2010 Hatzinikolas
2011/0107711 A1 5/2011 Foley
2013/0008121 A1 * 1/2013 Dalen ..... E04B 1/4178 52/704
2014/0059973 A1 * 3/2014 Duranleau ..... E04B 2/721 52/749.1
2014/0174014 A1 6/2014 Hatzinikolas
2014/0190110 A1 7/2014 Hatzinikolas
2015/0059259 A1 3/2015 Hatzinikolas
2016/0305113 A1 * 10/2016 Hatzinikolas ..... E04F 13/0857
2019/0136512 A1 * 5/2019 Naylor ..... E04B 1/2604
2020/0378132 A1 * 12/2020 Hatzinikolas ..... E04F 13/0805
2021/0285225 A1 9/2021 Hatzinikolas
2022/0056702 A1 2/2022 Hatznikolas

FOREIGN PATENT DOCUMENTS

DE 3128246 A1 2/1983
EP 1375777 A1 1/2004
GB 2417039 A1 2/2006
JP 101448097 B1 * 7/2020 ..... 42/6

* cited by examiner

SUPPORT BRACKET HANGER ASSEMBLY AND METHOD

FIELD OF INVENTION

This specification relates to structural materials for use in the construction of buildings, and, in one particular context, to support structure external veneer components.

BACKGROUND OF THE INVENTION

In former times, brick stone, or other masonry walls were load bearing structures. In contemporary building structures bricks, or other masonry elements, or other visible finished surface elements, are rarely load-bearing and tend more often to be employed as surface cladding on the exterior face of load-bearing structure.

When mounting face brick or stone veneer on the face of a wall structure, it is common to support the first row of bricks, or stone, or veneer on a steel support. In the art, the steel support for the masonry veneer may be termed in a "shelf angle". The "shelf angle" extends outward from the wall structure, and runs along, or has a major dimension extending in, a direction that is generally horizontal and cross-wise to the wall. The steel support is mounted to the load-bearing wall, or load-bearing framing, before brick-laying commences. The steel support may be welded to a steel anchoring system embedded in the wall. Alternatively, the steel support may be carried in spaced-apart brackets that have themselves been mounted to the load bearing wall structure.

In an era of energy conservation, the shelf angle is carried on brackets that stand outwardly from the load bearing structure, outside the vapor barrier and external sheathing (if any), so that the back of the shelf angle is spaced away from the structure. This is intended to leave spacing for insulation to be placed between the external sheathing of the building walls and the back of the shelf angle. Furthermore, in view of the tendency for condensation to form on the outer face of the insulation, it is also now customary to leave an air gap between the insulation and the back of the masonry veneer.

In earlier construction, either when the masonry was load-bearing or when the masonry was placed directly against the sheathing of the building envelope, either there was access to both sides of the masonry as it was laid, or the backing structure abutted the masonry. In either case, the mason could remove excess mortar at the time of brick laying and jointing, or the backing structure formed a barrier to mortar migration. By contrast, in a contemporary a masonry veneer wall, the air gap does not provide room to remove excess mortar with a trowel or provide space to use a jointer afterward. There is a tendency for excess mortar in the inside to fall between the masonry veneer and the insulation. The mortar that falls downward may block weep holes in the brick or may otherwise obstruct drainage passageways. Further, when a shelf angle is used, moisture trapped by fallen mortar on the shelf angle may tend to cause rusting. If the rust leaks, it may then stain the wall.

Shelf angles are used in a variety of contexts in building masonry veneer walls. Where the masonry veneer wall is tall, it is required to use shelf angles as a break in the wall if the wall is over a given height, such as 30 feet. In other circumstances, the shelf angle is used as the datum at the bottom edge of the commencement of the veneer cladding. In still other circumstances a shelf angle is used to establish the upper sill of a window or a door.

For one reason or another, a masonry veneer installation may employ a shelf angle at one height, but may also employ a second shelf angle at another, fairly close height. For example a long shelf angle may be used at or near the level of a floor slab, while another shelf angle may be used to establish a sill height for a door or window below that floor. Alternatively, one style of masonry veneer may be used at and above one shelf angle, while another style may be used above the other, as in circumstances where a change in brickwork pattern is intended by the architect to achieve a desired visual or textural effect. In such an instance, there is a need for shelf angles to be mounted in relatively close proximity.

In some instances, it is desirable to conceal the underside of the shelf angle be mounting a course of bricks below the shelf angle. To that end, the present inventor has considered ways of mounting masonry veneer underneath the shelf angle.

Further still, it may be desired to produce a textured or tiered masonry arrangement. In such an arrangement, the masonry may be above or below the shelf angle, and above or below the anchoring load transfer interface to supporting structure. Furthermore, there may be circumstances when the supporting structure, be it concrete or steel framing, extends outwardly from adjacent structure in a cantilever or overhang. In any of these cases, it may be desired for the masonry facing of the structure to be visible, while the support structure is hidden. This may include arrangements in which the masonry is applied underneath the supporting brackets. In other circumstances, the masonry veneer facing may be applied where there is an overhanging corner.

In all of these circumstances, supporting structure and shelf angles of configurations beyond those suitable merely for a planar, flat, featureless wall may be desired. The inventor addresses a variety of such situations in the embodiments shown and described herein.

SUMMARY OF INVENTION

In an aspect of the invention there is a two-part, separable masonry veneer support hanger assembly that mounts to a masonry support shelf angle, for mounting masonry veneer to supporting wall structure.

In another aspect there is a veneer masonry mounting hanger assembly. It has a first member and a second member that is removably attachable to the first member. The first member defines a hook that is operable to grapple, i.e., to sit upon, a vertical leg of a masonry veneer shelf angle. The first member defines a first mounting interface. The second member defining a second mounting interface. The second member has a foot that is profiled to conform to a masonry veneer. The first mounting interface and the second mounting interface are mutually engageable. The foot has at least one accommodation formed there through to admit the passage therethrough of re-bar and to accommodate mortar.

In a feature of that aspect, the first member has a first portion, a second portion, and a third portion. The first portion defines a downwardly hanging tab that includes the first mounting interface and that forms a root of the hook. The second portion defines an arm that forms a reach of the hook. The third portion defines a downwardly extending finger. The finger forms a tip of the hook. In an additional feature, as installed, the root of the hook lies behind the vertical leg of the shelf angle. The reach extends over the vertical leg. and the finger extends downwardly forwardly of the vertical leg of the shelf angle. In another feature, the root, the reach, and the finger define a crotch, and, when a veneer masonry load is mounted to the second member the vertical leg of the shelf angle seats in the crotch. In still another feature, the finger and the root are parallel and spaced apart to form a slot of width corresponding to the vertical leg of the shelf angle. In yet another feature, the first portion, second portion and third portion are formed from a single piece of sheet metal. and the third portion of the first member is bent out of plane to form a tab that, as installed, stands in planar opposition to a forward face of the vertical leg of the shelf angle, and, as installed, the tab is free of fastenings to the shelf angle.

In another feature, the second member is planar. In a further feature, the foot underlies a horizontal leg of the shelf angle. the foot has a toe and a heel. the toe extends forwardly under the shelf angle and the heel extends rearwardly thereof, and the toe is longer than the heel. In still another feature, the second member has an upwardly extending stem that mates with the tab of the first member behind the shelf angle. In a further feature, the foot is asymmetric relative to the upwardly extending stem.

In another aspect there is a veneer masonry support assembly. It has a first support bracket, a second support bracket, and a shelf angle. The first and second support brackets have rearward facing fittings by which to mount them to a supporting wall structure. The first and second support brackets have respective forward facing seats in which to receive the shelf angle. The shelf angle has a length to span the first and second support brackets. The shelf angle has a horizontal leg that defines a shelf upon which to mount masonry veneer, and a vertical leg that engages the respective forward facing seats of the first and second support brackets. When the shelf angle is mounted to the first and second support brackets the vertical leg of the shelf angle is spaced forwardly from the supporting wall structure by a spacing distance. There is a masonry veneer support two-part hanger assembly that has a first member and a second member. The second member is removably attachable to the first member. The first member defines a hook. The hook is operable to grapple the vertical leg of a masonry veneer shelf angle. The hook fits behind the shelf angle in the spacing distance. The first member defining a first mounting interface. The second member defining a second mounting interface. The second member has a foot, the foot is profiled to conform to a masonry veneer. The first mounting interface and the second mounting interface is mutually engageable. The foot has at least one accommodation formed there through to admit the passage therethrough of re-bar and to accommodate mortar.

In a feature of that aspect, the first member includes first, second, and third portions. The first portion defines a downwardly hanging tab that includes the first mounting interface and forming a root of the hook. The second portion defines an arm that forms a reach of the hook. The third portion defines a downwardly extending finger. The finger forms a tip of the hook. In another feature, as installed, the root of the hook lies behind the vertical leg of the shelf angle and stands outwardly rearwardly away therefrom. The reach extends over the vertical leg and stands in a plane upwardly away therefrom. The finger extends downwardly forwardly of the vertical leg of the shelf angle. In another feature, the root, the reach, and the finger define a crotch, and, when a veneer masonry load is mounted to the second member the vertical leg of the shelf angle seats in the crotch. The finger and the root are parallel and spaced apart to form a slot of width corresponding to the vertical leg of the shelf angle. In a further feature, the first portion, second portion and third portion are formed from a single piece of sheet metal. The third portion of the first member is bent out of plane to form a tab that, as installed, stands in planar opposition to a forward face of the vertical leg of the shelf angle between the vertical leg and the masonry veneer, and, as installed, the tab is free of fastenings to the shelf angle. In another feature, the second member is planar. The foot underlies a horizontal leg of the shelf angle. The foot has a toe and a heel. The toe extends forwardly under the shelf angle. In another feature, the second member has an upwardly extending stem that mates with the tab of the first member behind the shelf angle.

In a further feature, as installed, the first member is located in engagement with the vertical leg of the shelf angle between the first and second support brackets. The first member includes a first portion, a second portion and a third portion formed from a sheet metal blank. The first portion defines a downwardly hanging tab that includes the first mounting interface and forms a root of the hook. The second portion defines an arm that forms a reach of the hook. The third portion defines a downwardly extending finger. The finger forms a tip of the hook. As installed, the root of the hook lies behind the vertical leg of the shelf angle. The reach extends over the vertical leg. The finger extends downwardly forwardly of the vertical leg of the shelf angle, between the shelf angle and the masonry veneer. The finger and the root are parallel and spaced apart to form a slot of width corresponding to the vertical leg of the shelf angle. The hook is bent out-of-plane relative to the reach to present a flat tab in opposition to a forward face of the vertical leg of the shelf angle. The second member is planar, and has an upwardly extending stem that mates with the tab of the first member behind the shelf angle. and at least part of the foot extends forwardly under the shelf angle. In another feature, there are first and a second of the masonry veneer support hanger assemblies mounted to the shelf angle, and a course of bricks is mounted to the first and second masonry veneer support hanger assemblies. The course of bricks extends beneath the horizontal leg of the shelf angle.

BRIEF DESCRIPTION OF THE ILLUSTRATIONS

The foregoing aspects and features of the invention may be explained and understood with the aid of the accompanying illustrations, in which.

Figure 1:
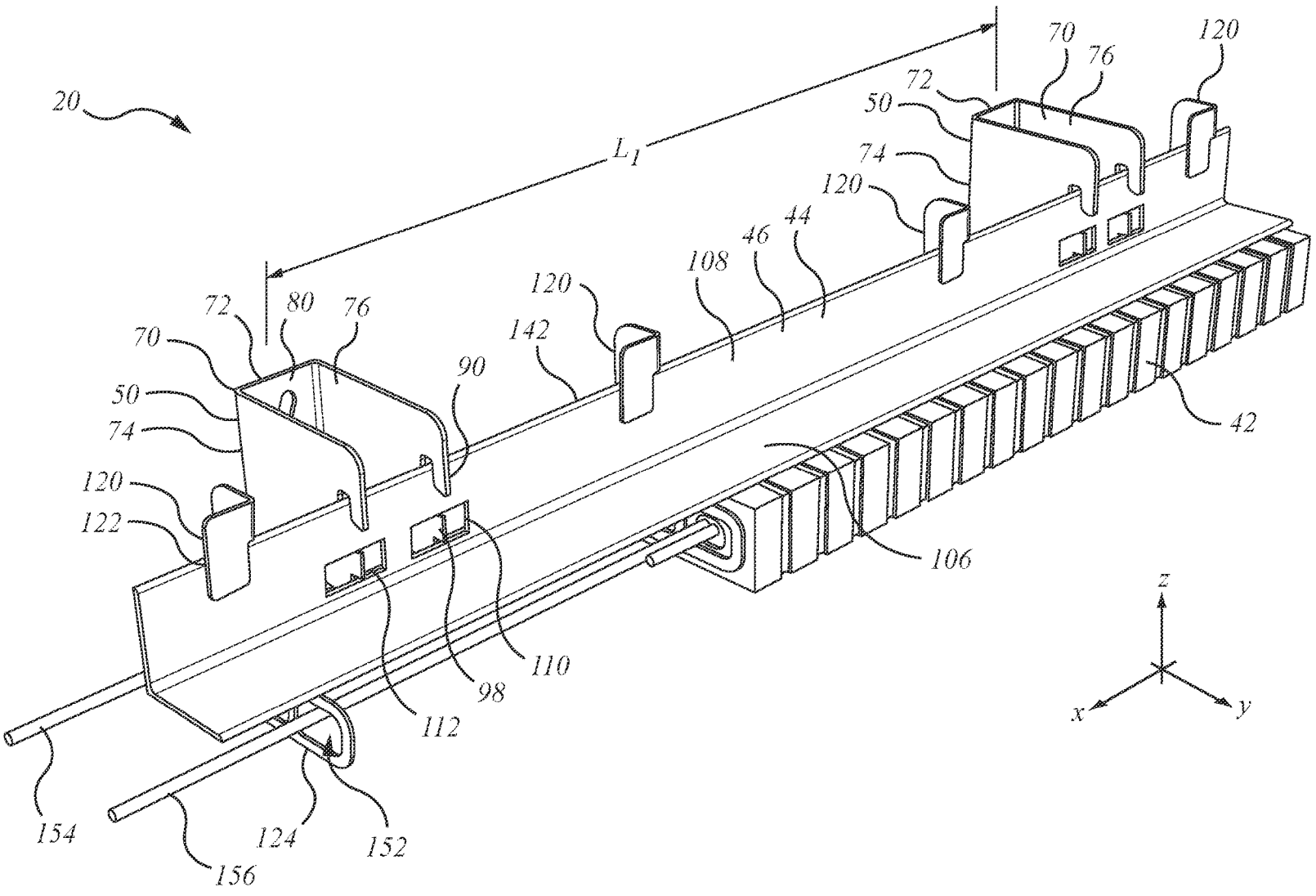
FIG. 1 is a perspective view of an assembly of masonry veneer wall support elements from above, in front and to one side.
Figure 3C:
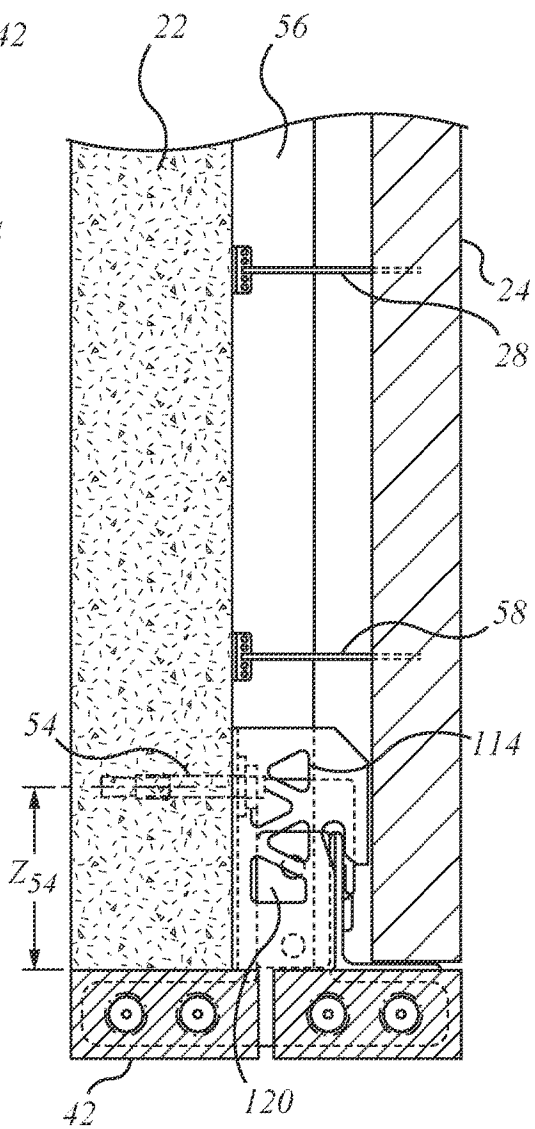
Figure 3B:
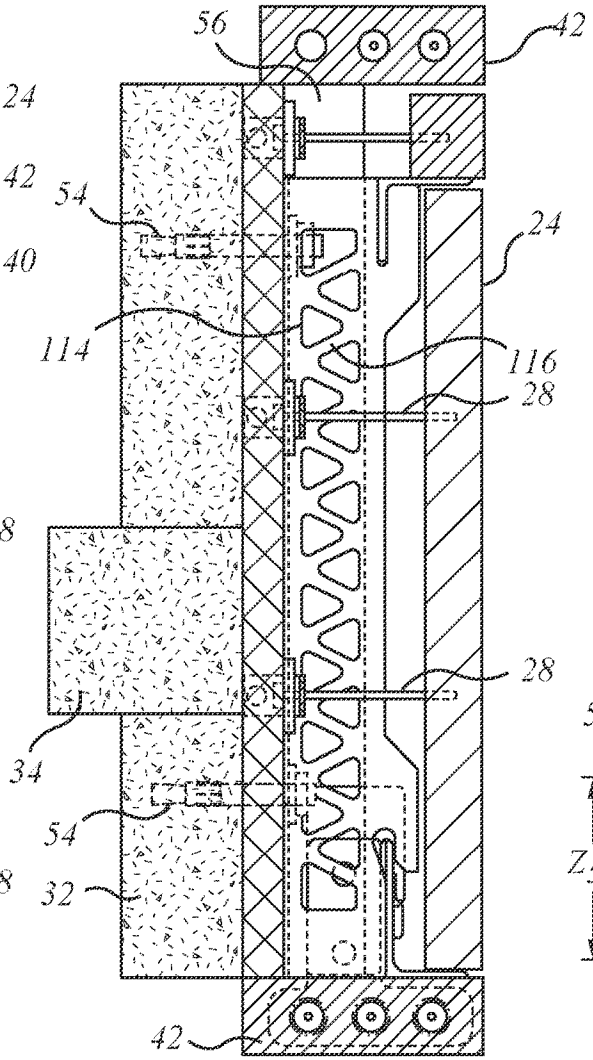
Figure 3A:
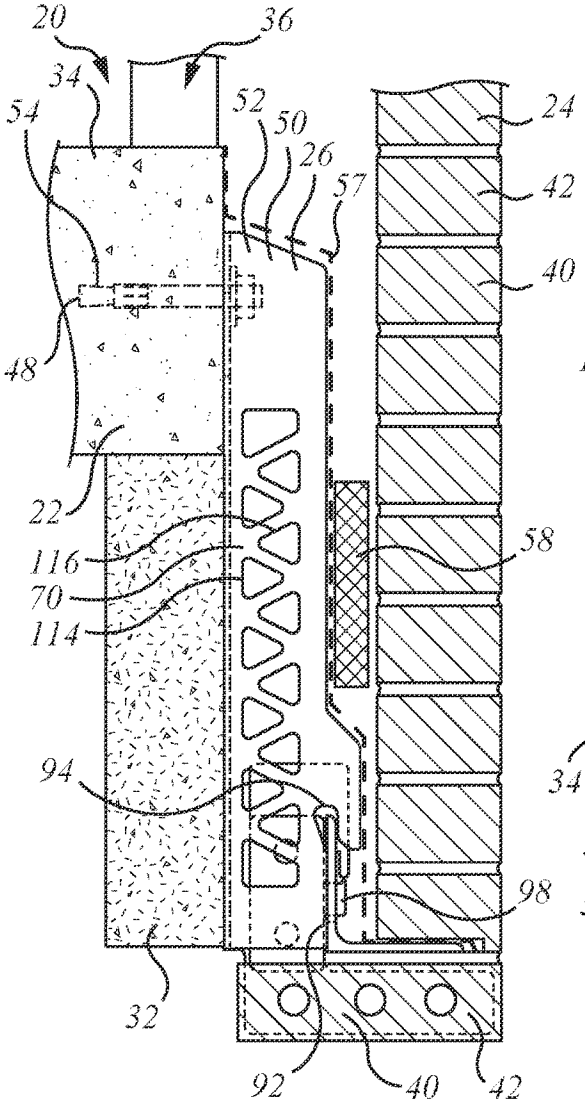

FIG. 3*a* is a side view establishing context of the assembly of FIG. 1;

FIG. 3*b* is an alternate side view to that of FIG. 3*a;*

FIG. 3*c* is another alternative to that of FIG. 3*a;*

Figure 2:
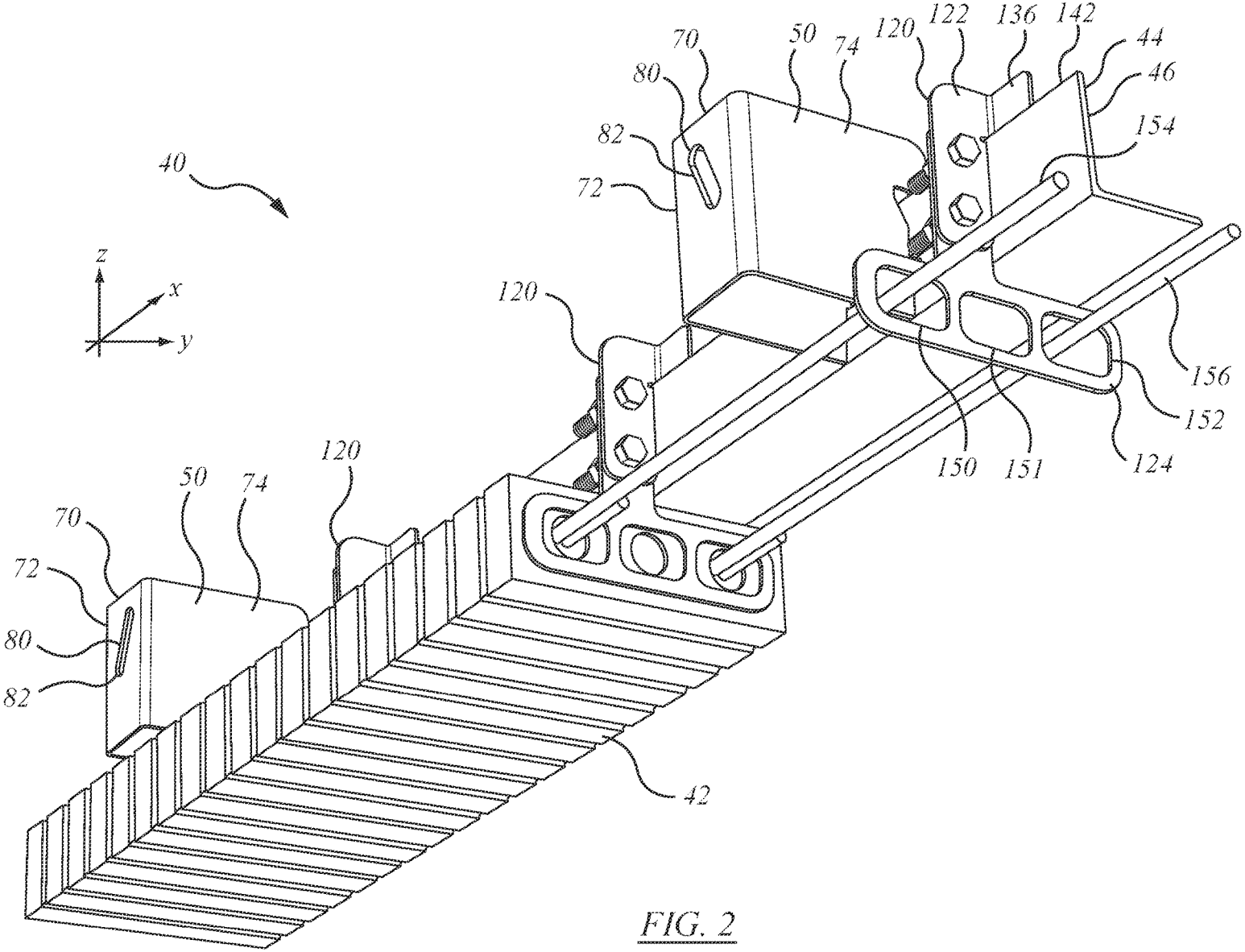
FIG. 2 is an opposite perspective view of the assembly of FIG. 1.
Figure 4:
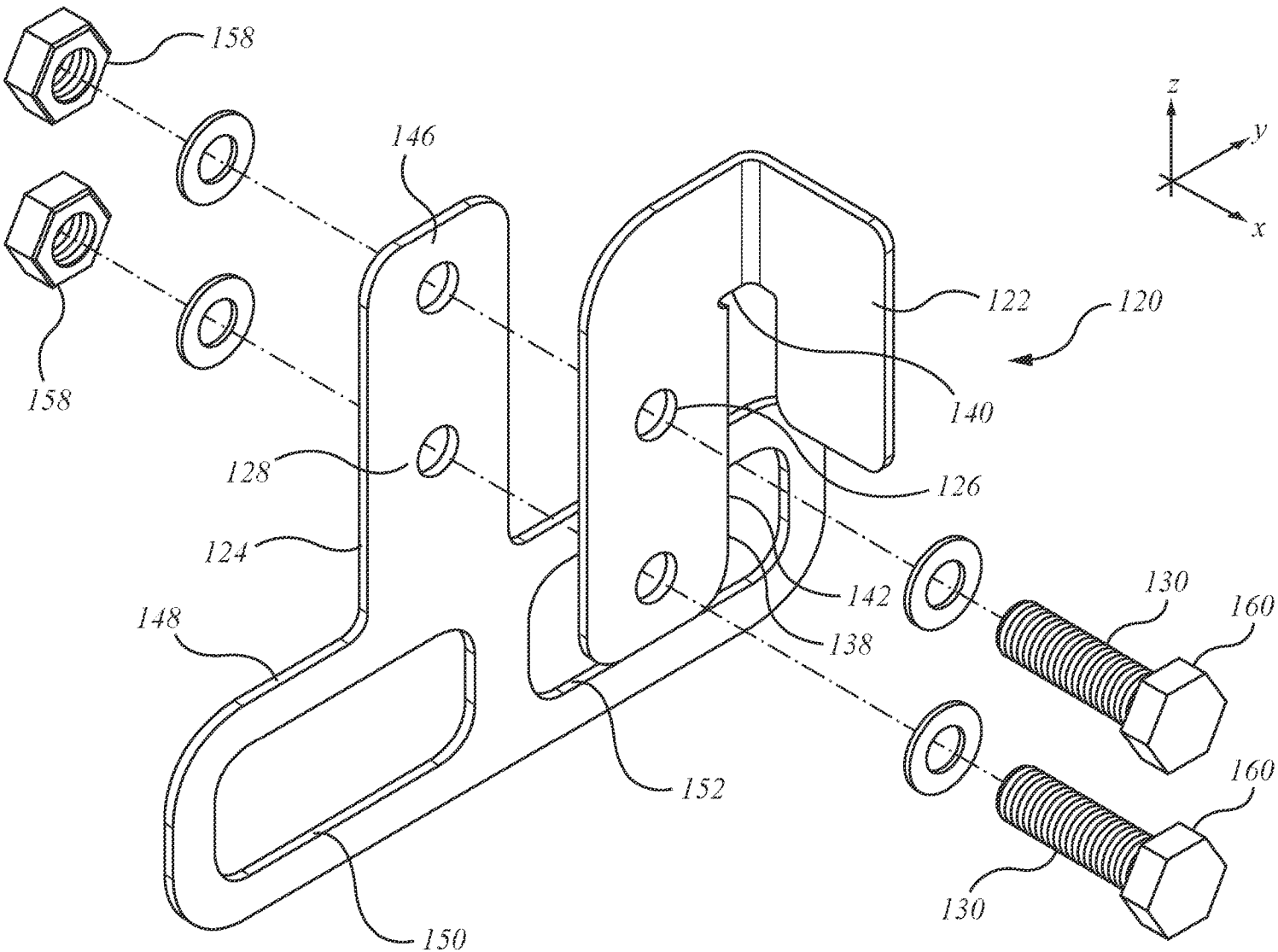
Figure 5:
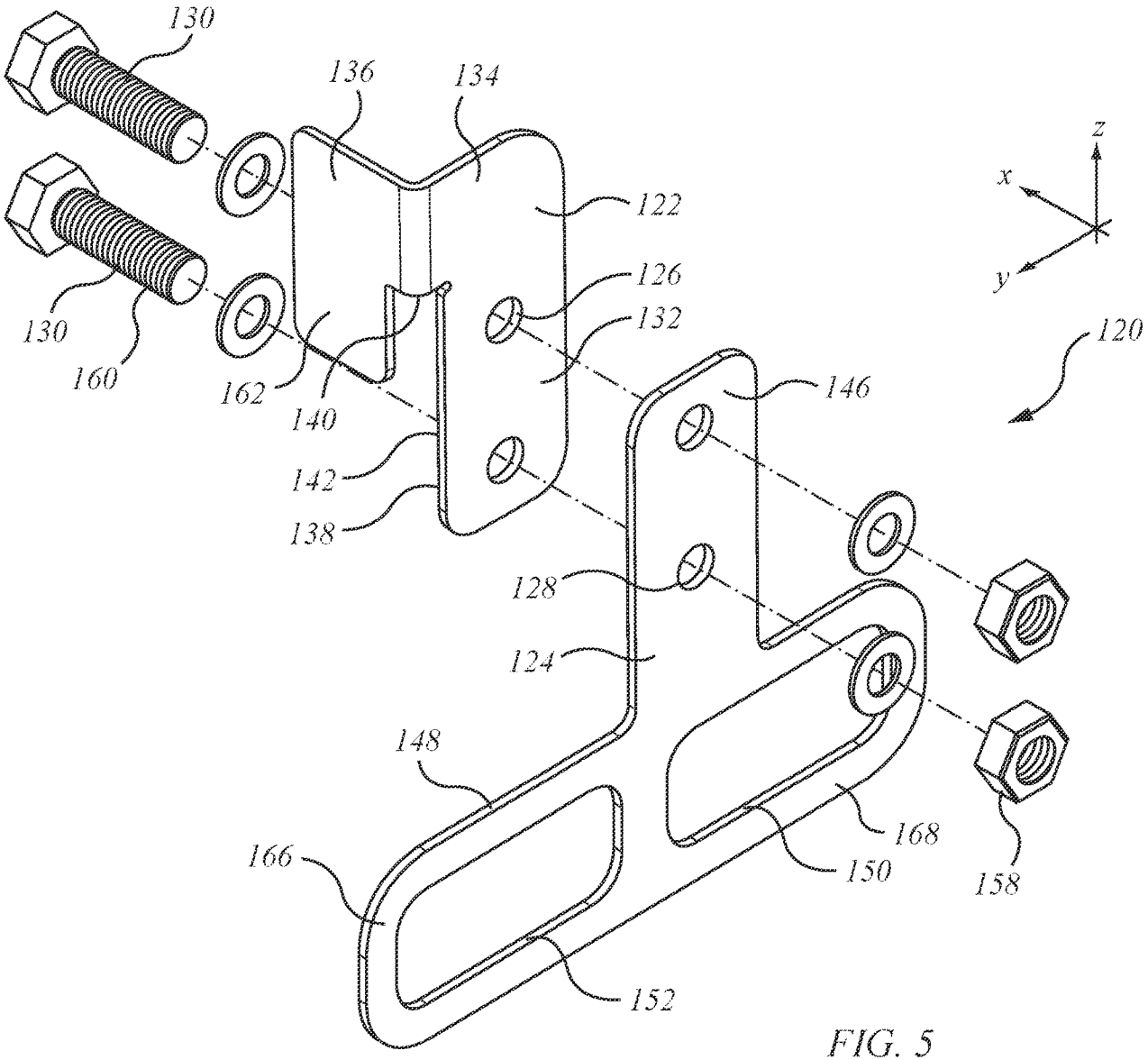
Figures 6A, 6B:
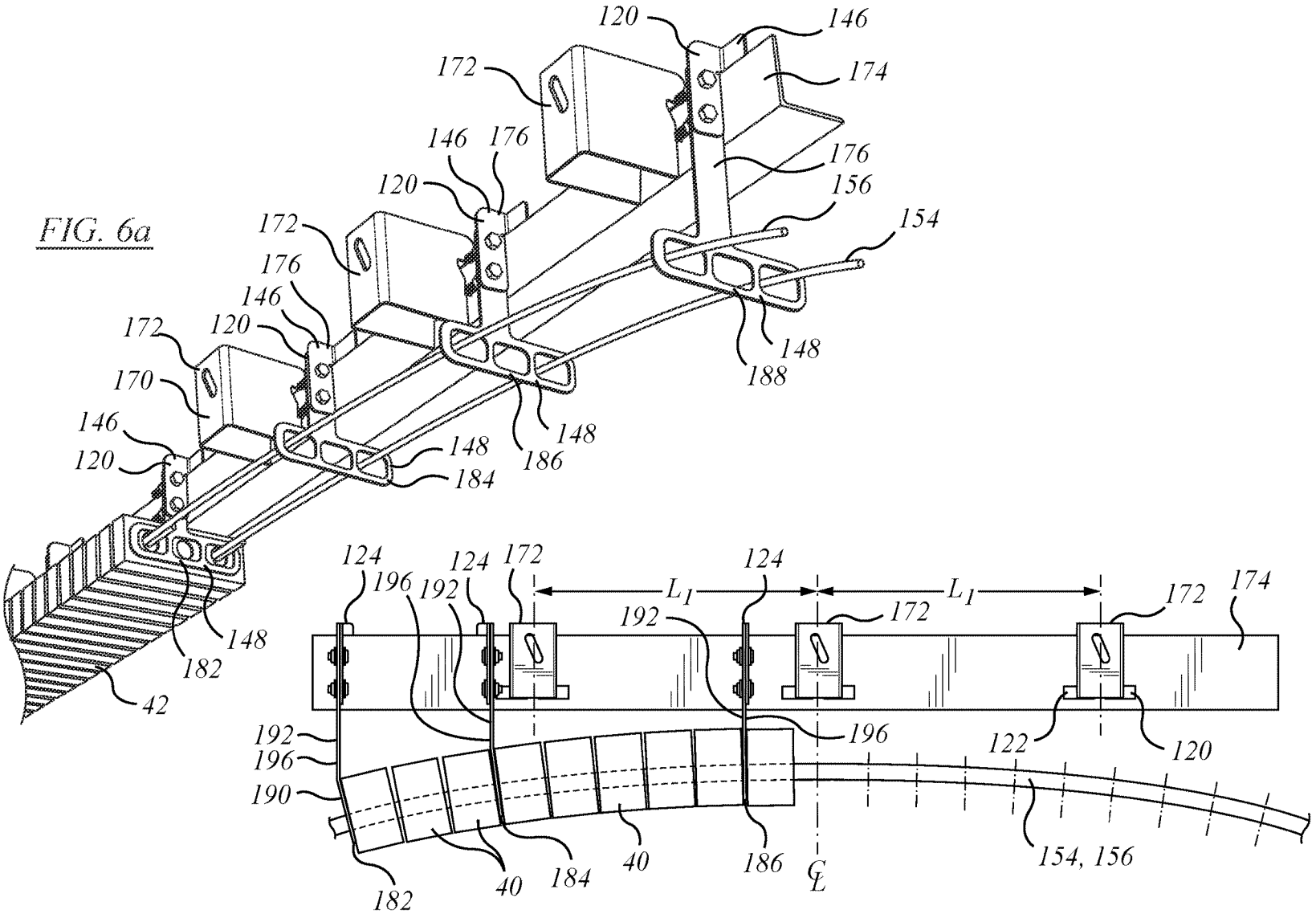

FIG. 4 is an isometric view of a hanger bracket assembly for the general arrangement of wall support elements of FIG. 1;

FIG. 5 is an opposite perspective view of the hanger bracket assembly of FIG. 4;

FIG. 6*a* is a perspective view of an alternate assembly to that of FIGS. 1 and 2 in which brickwork is formed on an arch or curve; and FIG. 6*b* is a further alternative assembly to that of FIG. 6*a.*

DETAILED DESCRIPTION

The description that follows, and the embodiments described, are provided by way of illustration of an example, or examples, of embodiments of the principles of the invention. These examples are provided for the purposes of explanation, and not of limitation, of those principles and of the invention. In the description, like parts are marked throughout the specification and the drawings with the same respective reference numerals. The drawings may be taken as being to scale, or generally proportionate, unless indicated otherwise. The terminology used in this specification is thought to be consistent with the customary and ordinary meanings of those terms as they would be understood by a person of ordinary skill in the art in North America. The Applicant expressly excludes all interpretations that are inconsistent with this specification.

This description relates to apparatus, such as shelf angle assemblies, for supporting masonry veneer, such as face brick or face stone, whether rough or finished. The masonry veneer, or whatever type, sometimes taken as having a weight of 35 lbs/sq.ft. of wall surface. The alternatives herein include a first member (or members), a second member and a third member, (or members), as may be. The first members may be wall mounting brackets. The second member may be a shelf angle. The third member may be a two-piece clip, or two-piece hanger that is suspended from the shelf angle.

In this description the term "shelf angle" is a term of art in the field of building construction and masonry installation. See: "*Technical Notes on Brick Construction*" by the Brick Industry Association, 1850 Centennial Park Drive, Reston, Va., 20191, www.gobrick.com (703) 620-0010, identified as 28B and dated December 2005, found at https://www.gobrick.com/docs/default-source/read-research-documents/technicalnotes/28b-brick-veneer-steel-stud-walls.pdf?sfvrsn=. The term "shelf angle" refers to an angle iron having a horizontal leg and a vertical leg. The horizontal leg defines a flat surface, or shelf, upon which masonry veneer is installed. The masonry veneer is typically in the form of bricks. The vertical leg of the shelf angle mates with mounting brackets that carry the vertical load of the veneer into the supporting wall structure. The shelf angle extends to span a number of mounting brackets. Unless stated otherwise, the first member, generally the mounting brackets; second member, generally the shelf angle; and third member, generally the two-piece hanger clips, may be taken as being made of steel, which may be a mild steel. Other materials, possibly such as stainless steel, may be suitable depending on the circumstances and the designed loads. The steel may have anti-corrosion or anti-heat transfer coatings, or both. A "shelf angle" is a substantial structural member, capable of carrying the 35 lbs/sq. ft. load of a masonry veneer, and is not to be confused with light metal railings for kitchen shelves, book-shelves, display cabinets in a retail display, or borders for gardens and walkways. A shelf angle has a forwardly extending leg that has a length, or reach, that exceeds the depth of face brick. Such a length may be 4 to 6 inches, or possibly more. The forwardly extending leg is a cantilever. The vertical leg forms the built-in root of the cantilever. The bending moment at the root of the cantilever is carried by the mounting of the vertical leg to supporting structure, usually through the medium of the support brackets that space the shelf-angle away from the supporting structure. This structure provides the moment couple reaction moment. A shelf angle can be understood to be a rolled steel member, having a back, or web, as hot-rolled from the steel mill, square to the horizontal flange, or shelf, upon which the masonry veneer sits. It has a material thickness that is generally at least ¾" or more, such as or 5/16", ⅜" or 7/16" or ½", with various lineal weights per foot. That is, it is a heavy, structural, load-bearing member as distinguished from thin, light-gauge sheet-metal that may have been roll-formed, stamped, or punched. Shelf angles are sometimes made in 20 ft or 40 ft lengths, cut to length, and, in some instances, may have mounting apertures or other fittings in the back as described hereinbelow, or machined, cut, or punched to yield the segmented form described in greater detail herein. Likewise, shelf angle mounting brackets are substantial structural elements of sizes, thicknesses and weights commensurate with the role of supporting shelf angles and the masonry veneer they carry.

In the various embodiments, the exterior of the mounting bracket may have an external coating. That coating may be a low thermal conductivity coating. It may be referred to as a thermal insulation coating, or a thermal resistance coating, or a thermal barrier, or thermal barrier coating, or thermal insulation layer. In this discussion, "low" thermal conductivity can be arbitrarily assessed as being less than 1 W/m-K. In general, thermal conductors such as metals and metal alloys have a thermal conductivity greater than 1 W/m-K. By contrast, materials commonly understood to be thermal insulators, such as wood materials, plastic resins, insulating ceramics, and so on, tend to have a thermal conductivity less than 1 W/m-K In some embodiments, the coating may have a thermal conductivity that is less than 1/50 of the thermal conductivity of the material from which the body of the mounting bracket is made, e.g., mild steel. In some instances the thermal conductivity of the coating may be less than 0.1 W/m-K. In this specification, various parts may be identified by multiple forms of terminology. This terminology may include multiple synonyms. The use of multiple terminology is intended to indicate that specific terminology is not necessary for understanding the concepts being described, but is intended to capture the broader meaning of the underlying concept that is common to the range of synonyms. The part is intended to carry the meaning of those synonyms, and any other synonyms for them whether or not explicitly recited in this specification. An annotation number may be associated with any such synonym, rather than using a different number for each different synonym.

Referring to the general arrangement of FIG. 1, there is a perspective view of a wall assembly, indicated generally as 20. In this description it may be helpful to consider a Cartesian co-ordinate frame of reference. The vertical, or up-and-down, direction may be designated as the z-axis, or z-direction. The direction perpendicular to the plane of the page may be considered as the longitudinal direction or x-direction, or x-axis, and may be taken as being the cross-wise direction of the wall. The left-to-right direction in the plane of the page, i.e., perpendicular to the wall, may be considered the sideways, or y-direction, or y-axis.

In this description, reference is made to load-bearing structure, and load-bearing wall structure. The description pertains to mounting bracket assemblies that support external facing veneer components, such as face brick, spaced away from the supporting structure as seen in the contextual views of FIGS. 3*a*, 3*b* and 3*c*. The mounting brackets are anchored to load-bearing structure. Whether that load bearing structure is a structural wall, or a concrete floor slab carried by framework, by a poured wall, by a block wall, or other load bearing members, in the context of this description whether it is a wall, a floor, or a ceiling, within the meaning of this specification it is a load-bearing wall structure to which the veneer supporting members may be mounted. The context of this description is further that of door openings, window opening, and overhanging masonry elements. That is, there are circumstances in which it is desirable to have underhanging masonry elements.

In terms of context, there may be a wall assembly 20 that has load-bearing structure, indicated generally as 22, and externally visible facing elements, indicated generally as 24. Load bearing structure 22 may also be referred to as a load bearing assembly or a load bearing wall structure. However it may be named, the externally visible facing elements 24 are mated to, or linked to, or stabilised by, load bearing structure 22. The linking, or positioning of the facing elements with the load-bearing structural elements may be achieved by the use of interface elements such as supports, or support assemblies, 26, and tying members or tying assemblies 28. Support assemblies 26 and tying members 28 may be taken as being made of steel unless otherwise noted. Combinations of load bearing frame or wall assemblies, such as 22, facing elements 24, support assemblies 26 and tying assemblies 28 may be assembled as indicated in FIGS. 3*a*, 3*b* and 3*c*.

Load-bearing structure 22 may have several different forms. First, it may include a foundation, which may be a poured concrete foundation 32. There may be a floor structure, such as a poured concrete floor slab 34. Floor slab 34 may carry a wall structure 36 which may have the form of laid blocks, or which may in other embodiments include a framed structure, such as may be a wood or steel framed structure. Visible facing elements 24 may include brickwork 40, or stonework, be it rough stone or finished stone, or other cladding. There are many forms of visible facing elements, which may be referred to generally as masonry veneer. Masonry veneer is often in the form of face brick. In the example shown, facing elements 24 are shown as bricks 42 laid in successive courses.

As seen in FIG. 1, support assembly 26 may have a set of first members 50. Each first member 50 may be a support bracket 52. Support assembly 26 may also include a base or bench or second member 44 that may have the form of a "shelf angle", or angle iron 46. Angle iron 46 runs along the wall structure in the horizontal direction and provides the bed upon which the lowest course of bricks finds its support, hence angle iron 46 may be termed a brick support. As installed, second member 44 mounts to first member 50, which is itself fixedly mounted to the load bearing wall structure. There may be several such "first members", spaced apart from each other and aligned such that a single shelf angle 46 spans the spaces between the first members, as seen in FIGS. 1 and 2. The vertical load of the facing, e.g., bricks 42 is carried by the bench or "shelf" of second member 44, and passed into such number of first members 50 as may support second member 44. In the example shown there are first and second such second support members 50 spaced laterally apart. For example, there may be several such supports on, for example, 16", 24", 30", 32" 36", 48" centers and so on. Whatever the pitch may be, indicated in FIG. 1 as spacing Li, it may correspond to the spacing, or double the spacing, of wall studs in the framing. First members 50 carry the shear load from second member 44 into load bearing wall structure 22. The depth of first members 50 in the y-direction (i.e., normal to the wall) may typically be less than the vertical height of first members 50, such that the webs of first members 50 may be considered low aspect ratio beams in which the bending moment is small.

First members 50 are secured to load bearing wall 22 by suitable means such as mechanical securements in the nature of threaded fasteners 54. In the case of securement to a poured concrete wall or floor slab (as shown) the fasteners may be concrete anchors. Fasteners 54 may be concrete anchor fittings 48, as shown in FIG. 3*a*, or embedded threaded rods, studs, or bolts. First members 50 have a depth (in the y-direction) that may correspond to, or may be greater than, the thickness of insulation panels 56 such as may be mounted to the front (or outside) face of the structural load-bearing wall assembly 22. There may also be a drainage shield, or flashing 57 such as may encourage moisture to drain outwardly of and away from structural wall assembly 26. A vapor barrier membrane may be, and typically is, captured behind insulation panels 56 upwardly of floor slab 34. There may be a mortar net 58 to impede accumulation of mortar on shelf angle 46, so that condensate dripping on shelf angle 46 may tend to drain away, or evaporate, more easily. Sheets of rigid insulation panels 56 are mounted over top of the membrane on the outer face of the wall. The anchor system allows insulation to be continuous. The rigid insulation may be of a thickness that allows an air space between the insulation and the external veneer brick facing mounted on shelf angle 46. The anchor brackets 52 may be made in a variety of sizes each corresponding to a desired thickness of the rigid insulation and air space. In this arrangement, a standard size of brick support shelf angle 46 may be used without regard to the spacing between the brick facing and the face of the wall desired for insulation. In some embodiments, tying members 28 may be located upwardly of shelf angle 46. Tying members 28 may be brick ties.

Considering FIGS. 1 and 2, support bracket 52 may have the form of a channel 70 having a first member in the nature of a rear plate or back 72, and a second member in the nature of a web or leg 74. Channel 70 may also have a third member in the nature of a second web or leg 76. In the embodiment shown, legs 74 and 76 stand outwardly of back 72. That is, as installed back 72 may lie in an x-z plane abutting the load bearing structure, be it framing, metal girders, poured concrete wall or poured concrete slab, and so on. Legs 74 and 76 stand outwardly away from that x-y plane. In general, it may be convenient that legs 74 and 76 stand in y-z planes perpendicular to the plane of back 72, standing spaced apart and parallel, but this is not necessarily so. For example, legs 74, 76 could be splayed to form a V or winged shape as opposed to a square-sided U. In the example, legs 74, 76 are a pair of side plates that extend from respective sides of the rear plate, back 72, in a direction away from the wall to form the sides of the U-shaped channel. The side plates are generally rectangular in shape and lie in respective vertical planes.

Back 82 has a mounting, a seat, or an attachment fitting 80 such as shown in FIG. 2 by which a mechanical fastener secures bracket 52 to the load bearing wall structure. In general, a shim plate, such as may be substantially similar in size to the anchor bracket, may be mounted between each anchoring bracket and the outer face of the wall (i.e., load-bearing wall assembly 22), as suitable, for evenly engaging the concrete surface and for spacing each anchor bracket 52 from the wall as desired to accommodate irregularities in the outer face of the wall. Fitting 80 may be a slot 82 that permits height adjustment of bracket 52. Slot 82 may be oriented at a non-parallel angle or direction that is skewed relative to the vertical axis. Slot 82 may be an elongate aperture in back 72 that extends along an inclined axis 73 angularly offset from vertical. The inclined axis may be offset 22.5 degrees from vertical. In a right-hand configuration it may be offset in the opposite direction. The upright plate of back 72 can thus be fastened to the wall at numerous locations corresponding to different positions of the bolt within the slot. As installed, the fastener may be in tension, and the lowermost edge of back 72 may be in compression, i.e., pressed against the load-bearing structure, such that there is a moment reaction and a moment arm. Slot 72 may be located closer to the upper margin of bracket 52 than to the lower margin, such that moment arm $z_{54}$ of the reaction of bracket 52, defined as the distance from the centerline of fastener 54 to the lower margin, is typically greater than half the height of bracket 52. Slots 72 of successive brackets 52 may be alternately left-handed and right-handed. That is, in use, a plurality of anchor brackets may be spaced horizontally across a wall using a chalk line. On installation, the vertical shear load tends to urge the brackets to wedge and lock in position.

The side plates defined by legs 74, 76 receive and carry the brick support defined by shelf angle 46. Looking at leg 74 as being representative also of leg 76, and considering the profile shown in FIGS. 3*a*, 3*b* and 3*c*, the distal portion of leg 74 (i.e., the portion standing away most distantly from back 72) has a fitting, or accommodation, or seat 84 that is matingly co-operable with second member 44, and that provides a shear load transfer interface in which a vertical gravity load from member 44 is transferred into web 74 (or 76 as may be). The profile of each seat 84 in the respective side plates of legs 74, 76 may have the appearance of a recessed channel in the forward or foremost, or distal edge or margin thereof. The seat has the features described in U.S. patent application Ser. No. 16/426,801. For brevity, the details of that description are deemed to be included herein.

A lower reaction member, or abutment, 92 extends upwardly and away from the root of toe 98. The upper and lower stops (i.e., overhanging finger 90 and abutment 92) constrain the translational degree of freedom of corresponding upper and lower regions of angle iron 46, and thus define a moment-couple reaction inhibiting motion in the rotational degree of freedom about the x-axis of angle iron 46 in the counter-clockwise direction, thus preventing the offset weight of the masonry veneer from causing the shelf angle to rotate forward.

The overall height of seat 84 may be taken from the vertical shear transfer receiving interface of the shoulder of the supporting protrusion to the uppermost extremity of the slot in which the back or the shelf angle is received. As shown the most distant extremity of toe 108 is the same distance from back 82 as is the most distant extremity of finger 90. Although mounting brackets 52 of FIGS. 1 and 2 are shown as having a low aspect ratio of height in the z-direction to depth in the y-direction, and seat height is shown as being comparable to the projection depth in the y-direction from the wall structure, this need not be the case, and the support bracket 52 may be long-legged as in FIGS. 3*a* and 3*b*. Where an installation is made over a door or window or archway, the mounting bracket 52 may have a fitting 80 at a higher level, such as may correspond to a floor slab or other structural frame feature, and a seat 84 that hangs down to a level appropriate for establishing the local shelf angle height relative to that lower door, window, or archway opening, as in FIGS. 3*a*, 3*b*, and 3*c*. Bracket 52 may be single ended (i.e., having a shelf angle seat at only one end) and long-legged as in FIG. 3*a*; double ended (i.e., having a shelf angle seat at both ends) as in FIG. 3*b*; or single ended and short legged as in FIG. 3*c*.

The brick support defined by angle iron 46 may include a mounting flange which engages anchor bracket 50, and a supporting flange arranged to carry bricks. The mounting flange and the supporting flange may typically be mounted at right angles to form an L-shaped angle iron, typically made of steel. As in FIG. 3*a*, angle iron 46 has a first or horizontal leg 106 and a second or vertical leg 108. In the examples shown, horizontal leg 106 and vertical leg 108 meet at a square corner and have an internal radius. Horizontal leg 106 extends forwardly (in the +y direction) away from vertical leg 108, and hence on installation also forwardly and away from bracket 52. Horizontal leg 116 runs along the wall structure in the x-direction. The running length of the angle iron in the x-direction is much greater than the horizontal leg length in the y-direction. In one example the running length may be 72 inches, while the leg of the angle may be 6 inches or less. In various examples the x:y aspect ratio of lengths may be in the range of 4:1 to 16:1. Shelf angle 46 may be cut to length as may suit. As installed, the length of leg 108 proud of the end of toe 98 in the y-direction may have a length corresponding to the depth in the y-direction of the facing members to be supported. In the case of face brick, that length corresponds to the depth of the face brick. In some embodiments it may be somewhat less than the depth of the face brick to permit the iron to be less noticeably visible or to be hidden, as in FIGS. 3*a*-3*c*.

As shown, vertical leg 108 has an accommodation, slot, aperture, socket, or relief, or reliefs 110, 112 spaced upwardly from the junction of members 106 and 108. The lower margin of reliefs 110, 112 may be located at or above the run-off of the rolled radius between members 106 and 108, i.e., in the tangent portion of the vertical leg, rather than in the radius. Reliefs 110, 112 are sized to receive the dogs, or toes 98 of web members 74 or 76. They are over-sized in the x-direction to permit lateral adjustment of bracket 52, as, for example, according to the fastener position along inclined slots 82. For half inch thick legs, the slot may be 2.5 inches wide, giving, potentially, one inch play to either side of center. The height of the slot may be slightly oversize to permit rotating installation of bracket 52. The vertical through thickness of each toe 98 may be 1" or more.

In the engagement of toe or dog 98 in accommodation or relief 110 or 112, as may be, the lowermost margin of leg 74 (or 76) does not extend lower than (i.e., downwardly proud of) the bottom of horizontal leg 106, such that no additional vertical clearance allowance is required for toe 98. Toe 98 is then concealed behind the external veneer and the bottom edge of the lowest course of bricks may be lower than otherwise. Expressed differently, first member 50 may be considered the receiving member, and second member 44 may be considered the received member. The received member is flush with, or extends downwardly proud of, the lowermost portion or extremity of the receiving member and may tend to conceal the receiving member from view. It also leaves the underside of the horizontal leg of the shelf angle clear of obstructions, so that underhanging brickwork can be installed flush against the underside of the horizontal leg of the shelf angle. The engagement of the receiving and received members is a mechanical interlocking relationship that is biased into securement by gravity acting on the load. That is, while the angle iron may be adjustable and engageable while unloaded, the loading of bricks or other surface elements may tend to increase the moment couple on the angle iron, such as may tend to tighten the hold of the moment couple reaction members of the receiving member.

In general, the received member has a first portion that defines a seat or bench, or accommodation, or support, or platform or under-girding, or shelf, for the externally visible facing members, hence the term "shelf angle". It is a form of sill. The received member also has a second portion that engages the receiving member such that vertical load from the received member is transmitted into the receiving member and thence into the load-bearing supporting wall. The second portion can be termed an engagement fitting, or key, or inter-locking feature, or indexing feature, that mates with the receiving member. It happens that a square, L-shaped angle iron conveniently has these properties.

In the embodiment shown in FIG. 3*a*, since as each leg 74, 76 may pass through the wall insulation panels 56, each leg may also have an array of apertures as at 114, such as may reduce the section for heat transfer in the y-direction. In some embodiments apertures 114 may be non-circular, and may have a triangular, oval, oblong, or elliptical form. The interstitial strips 116 between adjacent apertures may tend to be correspondingly inclined on a generally diagonal angle. There are many possible variations of leg length and web opening apertures as described in U.S. patent application Ser. No. 16/426,801, and as suggested by the variety of FIGS. 3*a*, 3*b* and 3*c*.

The examples herein address the circumstance where the shelf angle support assembly is to be within the masonry veneer, such that the support assembly is not seen from beneath. As illustrated, a row of bricks is to be located underneath the shelf angle. To that end, a hanger assembly 120 is provided. Hanger assembly 120 includes a first member 122, and a second member 124, that mates with, and, as installed, is secured to first member 122. First member 122 may be termed the shelf angle engagement member. Second member 124 may be termed the masonry veneer engagement member. They have respective fastener fittings in the form of respective bores 126, 128 that admit threaded fasteners 130 that may be nuts and bolts or rivets by which they are held immovably together.

First member 122 has first, second, and third portions 132, 134, 136. First portion 132 has the form of a downwardly depending tab 138 having bores 126. The back surface of tab 138 forms the land, or mating interface, that contacts second member 124. Tab 138 need not be planar. It could be curved, or have accordion folds, or zig-zag folds, or it could be sinuous when viewed in profile on edge (with second member 124 having the mating negative image of such folds or zig-zags, etc.) The rear surface of tab 138 could be knurled, or have serrations, or ridges-and-grooves, again, for mating engagement in physical mechanical interlocking relationship with the corresponding mating surface of second member 124. As shown, it is planar and flat, as convenient. Second portion 134 is a forwardly extending member, or arm that, as installed, over-reaches upper edge 142 of vertical leg 108 of shelf angle 46. Third portion 136 is an extremity of the arm of second portion 134. It extends vertically downwardly of the arm, and of the upper edge of the vertical leg 108 of shelf angle 46, effectively forming the end of a hook. Third portion 136 has been bent such that its large, flat face lies in planar opposition to the front face of the upper portion of vertical leg 108 of shelf angle 46.

When viewed looking in the x-direction along the top edge of the shelf angle, the space beneath second portion 134 and between the forward edge of first portion 132 and the rearward facing surface of third portion 136 define a crotch 140 that seats on top of the upward edge 142 of vertical leg 108 of shelf angle 46. This crotch defines the vertical shear load transfer interface between first member 122 and shelf angle 108. It may be noted that the vertical depth of the shear web defined by second portion 132 is the full depth of second portion 132. It may be noted that the inner corner at the top of forward margin 144 of first portion 132 has a fatigue relief as indicated at 146.

Looking now at second member 124, it has a first portion 146 and a second portion 148. First portion 146 can be called the shank or stem of second member 124. It is in essence a tab that has the negative form of the downwardly extending tab 138 of first portion 132 of first member 122. As noted above, it could have a bent mechanically interlinking shape, or knurling, or serrations, and so on. In the example shown it is planar and flat. It defines the interconnection interface of second member 124 for mating with first member 122. Second portion 148 is the cross-member of second member 124 that hangs down from the stem defined by first portion 146. Second portion 146 has apertures or accommodations 150, 152 formed therethrough to permit passage of re-bar 154, 156 as seen in FIG. 2, and also to admit a fair dollop of mortar. "A fair dollop" is defined as being the amount of mortar used between two soldier bricks lying side-by-side to sandwich second portion 148 on installation.

In making an under-hanging course of brick-work, there is a combination of bricks, mortar, re-bar, and hangers. It is possible to build up such a course of bricks by building wooden form-work below the installation, and then building up the course brick-by-brick, one at a time. When re-bar is added, each additional brick can only be added by feeding the internal holes in the brick onto the rebar, and sliding the brick axially into place along the rebar, adding the mortar, and repeating the process with the next brick. The process of setting the brick causes the mortar to fill the internal holes in the brick, and to fill the space between the adjacent bricks. Where a hanger is required, the hanger is slid along the re-bar in the same way, and positioned in place, followed by the next brick.

A somewhat more efficient way to undertake this process is to pre-assemble sections of courses of bricks, to leave only a few bricks at the end of the course to be installed individually. The pre-assembled sections may include re-bar. The pre-assembled sections may be lifted into place with a crane or hydraulic lift, and supported on shoring while mortar is set and cured. The pre-sect sections may include hangers that are already set in the course. The hangers of those sections may permit sections to be installed without shoring, or with less shoring than might otherwise have been required.

To that end, the first member, or set of first members, 122 can be set on the top edge of shelf angle 46, with tab 38 hanging downward behind vertical leg 108 of shelf angle 46. The section of bricks is then lifted into place, and the upwardly extending stem 146 is mated with downwardly extending tab 138, and fastened together, e.g., with nuts and bolts 158, 160 as shown. The first portions 122 can slide along the top of leg 108 in the x-direction to suit, as appropriate to match the spacing and placement of second portions 124 to locate the masonry elements in the correct position.

Making hanger 120 in two parts permits installation the hangers to be installed after shelf angle 46 is in place in the receiving brackets 52. If it were a single piece, the overhang of the down-hanging hook would otherwise require all the hangers to be slid on from one end of shelf angle 46 before installation. By separating it into two parts, the first member 122 can be put in place, alone by sliding vertically downward, and the second member 124 can be slid upward, such that shelf angle 46 is effectively captured in the z and y directions by the assembled hanger 120.

In a previous alternative shown in U.S. patent application Ser. No. 16/426,801, FIG. 20c shows a one-piece bracket in which the brick-engaging foot or cross-head of the hanger extension is formed as one piece of the bracket. However, the use of a one-piece bracket requires that the entire bracket be formed as a special pattern, which may be used only in a small number of places. Further, the use of the one-piece bracket as shown is more difficult since the lateral fit-up of the bracket on its mounting has to adjust vertical fit of the bracket on the wall structure, horizontal fit on the wall structure, vertical fit of the brick course and horizontal fit of the brick course along shelf angle 46. However, to fit these four degrees of geometric freedom there is only a single adjustment fitting. Similarly, in FIGS. 20*d* and 20*e* of that application, the brick-engaging cross-head of the hanger is bolted through vertical leg 108 of shelf angle 46. This requires that the shelf angle be drilled prior to installation, and that the drilled holes be drilled in the correct position. While this provides some tolerance in a second degree of freedom in the x-direction, it requires a pre-positioned penetration in the shelf angle, and it provides no adjustment if that penetration is in the wrong place.

By contrast, the crotch of hanger 120 can slide along vertical leg 108 to such position as may suit. It does not rely on locating the locking hook or tab relative to a penetration in the vertical leg. The locking hook or tab locates without the requirement of a mechanical fastener. It does not require a relatively custom made bracket, but can use a relatively standard shelf angle mounting bracket, whether shot-legged or long-legged as suitable. It permits the relatively simple installation of a hook on the shelf angle, without the need for fasteners or special tools. The installation of hanger 120 on shelf angle 46 relies not on mechanical fasteners such as bolts or rivets, but rather upon mechanical interlinking of parts held in place by the bias of gravity, which becomes tighter under load. The crotch inhibits motion in the forward and rearward y-direction; the crotch and gravity inhibit motion in the z-direction. The assembly retains a degree of freedom of motion in the x-direction to shift laterally along shelf angle 46.

Moreover, the cross-head of second portion 124 need not be as shown. It could be suitable for one course of bricks, or two courses of bricks. It could be suitable for standard bricks or extra-long bricks. It could be set to take bricks lying horizontally as shown, or standing as vertical soldiers. Each of these alternate embodiments requires only a change of second member 124 to the desired size, profile, and orientation. It does not require any change in first member 122. As may be noted, second member 124 is substantially planar so that it will fit in the mortar allowance between two adjacent bricks. As a flat piece of sheet metal it is stamped out of a flat plate, without further processing. First member 122 does not change in design, and is made of a smaller, simple piece of sheet metal, cut to its desired profile shape and then bent to its finished configuration. First member 122 remains the same, whatever may be the size or shape of second member 124 may have.

To summarise, there is a two-part, separable masonry veneer support hanger assembly 120 that mounts to a masonry support shelf angle 46, for mounting masonry veneer 40 to supporting wall structure 22. The hanger assembly has a first member or part or portion that defines a catch or hook 122, and a second member or part or portion that defines a stem or foot 124, that is removably attachable to the first member. The first member defines a hook or catch that is operable to grapple or grasp, i.e., to sit upon, a vertical leg of a masonry veneer shelf angle. The first member defines a first mounting interface, namely with mounting fittings 126 and the back surface of tab 138. The second member defines a second mounting interface, including mounting fittings 128 and the front face of stem 146. The second member has a foot 148 profiled to conform to masonry veneer 40. The first mounting interface and the second mounting interface are mutually engageable. The foot has at least one accommodation, such as rear and front openings 150, 152 of FIGS. 4 and 5, or rear, middle and front openings 150, 151 and 152 of FIG. 2, formed therethrough to admit passage therethrough of re-bar 154, 156, and so on, and to accommodate mortar.

In a feature of that aspect, first member 122 has a first portion 132, a second portion 134, and a third portion 136. First portion 132 defines downwardly hanging tab 138 that includes the first mounting interface and that forms a root of the hook of first member 122. Second portion 134 defines an arm that forms a reach of the hook. It is joined to, and extends forwardly from, first portion 132. Third portion 136 defines a downwardly extending finger that is joined to, and extends downwardly from, second portion 134. The finger 136 forms a tip of hook 122. As installed, the root 132 of hook 122 lies behind vertical leg 108 of shelf angle 46. Reach 134 extends over the upper edge 142 of vertical leg 108 and finger 136 extends downwardly forwardly of vertical leg 108 of shelf angle 46. The root, reach, and finger co-operate to define an accommodation in the shape of an inverted pocket or crotch 140. When a veneer masonry load is mounted to second member 124, vertical leg 108 of shelf angle 46 seats in crotch 140. Finger 136 and root 132 are parallel and spaced apart to form a slot 146 of width corresponding to the through-thickness in the y-direction of vertical leg 108 of shelf angle 108. First portion 132, second portion 134 and third portion 136 are formed from a single piece of sheet metal. Third portion 136 of first member 122 is bent out-of-plane on a square corner to form a tab 162 that, as installed, hangs down and stands in planar opposition to the forward face of vertical leg 108 of shelf angle 46, and, as installed, tab 162, and therefore all of first member 122, is free of fastenings the shelf angle 46.

In the example of FIGS. 4 and 5, second member 124 is planar. It stands in a plane that is transverse to the long axis of shelf angle 46, and in the example shown it is square (i.e., perpendicular) to shelf angle. Foot 148 underlies horizontal leg 106 of shelf angle 46. When the corresponding bricks 42 are installed, they may abut the underside of horizontal leg 106. Foot 148 has a toe 166 and a heel 168. Toe 166 extends forwardly under shelf angle 46 and heel 168 extends rearwardly thereof. In the example, toe 166 is longer than heel 168, such that foot 148 is asymmetric relative to stem 146. Second member 124 has upwardly extending stem 146 that mates with tab 138 of first member 122 behind shelf angle 146.

Second member 124 need not be planar, and the stems of adjacent members 124 need not be of the same length. That is, it may be desired to form a curved archway over a door or window opening. This is seen in the examples of FIGS. 6*a* and 6*b*. In such a circumstance, an arch wall assembly has a support assembly 170 that has a set of first members 172, which may be taken as being the same as support brackets 52; and a second member 174 which may be taken as being the same as shelf angle 46; and a set of third members 176 which may be taken as being the same as hanger assemblies 120, except that the hangers are not of uniform length. Rather, the lengths of the stems are varied. To the extent that a curve or arch is being formed, starting from the shortest stem 146 at the center of the arch, identified as 182, successive second members 124 of the hangers, i.e., third members 176 of support assembly 170, may have increasingly longer stem portions 146, identified as 184, 186, and 188, as in FIG. 6*a*. In the example of FIG. 6*a* the stems and feet are shown as being planar. Alternatively, however, as in FIG. 6*b*, the respective second members 124 of hangers 196 may have respective foot portions 190 that are increasingly angled relative to the plane of the upper portion of stem 192 to correspond to the increasing angle of the soldiers of the arch as they become more distance from the center. Alternatively, the stem and foot may themselves remain planar, but, since the hanger is able to "swing" on its contact point with the top of the shelf angle, the angle at which the hook engages the top of edge of the shelf angle may then correspond to the complement of the angle of the soldiers between which the specific foot is mounted. Bending the foot permits the installation to be directly vertical. In either case, for a curved-arch installation, second members 124 may be supplied with over-long stems 146 that are not pre-drilled with holes 128. Rather, after wooden form-work has been built to define the resting surface upon which the mortar will set between the bricks, stems 146 can be positioned relative to the form-work, aligned, and marked at the appropriate heights to mate with tabs 138 of the corresponding first members 122, and then drilled with holes 128 to suit. In both FIGS. 6*a* and 6*b* the illustrations show partial constriction, waiting for additional bricks 42 and hangers, i.e., third members 176 or 196, as may be, to be installed.

The veneer masonry support assembly has first and second support brackets 50, and a shelf angle 46. First and second support brackets 50 have rearward facing fittings 80 by which to mount them to a supporting wall structure 22. First and second support brackets 50 have respective forward-facing seats 84 in which to receive shelf angle 46. Shelf angle 46 has a length to span first and second support brackets 50. Shelf angle 46 has horizontal leg 106 that defines a shelf upon which to mount masonry veneer 40, and a vertical leg 108 that engages the respective forward-facing seats 84 of first and second support brackets 50. When shelf angle 46 is mounted to first and second support brackets 50, vertical leg 108 of shelf angle 46 is spaced forwardly from supporting wall structure 22 by a spacing distance. There is a masonry veneer support two-part hanger assembly 120 that has a first member 122 and a second member 124. Second member 124 is removably attachable to first member 124.

On installation, a hoarding, or support, or false-work, may be constructed in a position to support a string of bricks, set on end, between one foot 148 and its next adjacent foot 148 and its mates, however many there may be. As the bricks are put in place, their internal openings are filled with mortar. The reinforcement rod, re-bar 154, 156 is then threaded through the aligned holes, or whatever configuration. When the mortar has set, the bricks will be held in fixed position on the re-bar, and shelf angle will be above the lowermost course of bricks. The use of two (or more) re-bars of course presents a spaced-apart moment arm, thus discouraging the bricks from rotating in the vertical plane. Once set, the false-work is removed. It may be desired for the under-hung row of bricks to lie flat, rather than on end. Foot 148 has an array of apertures that are spaced horizontally. The shelf angle will then not be visible.

The present description provides examples and explanations that address a number of installation challenges that may present themselves during the installation of masonry veneer, particularly in circumstances where the installation diverges from installation in a large plat plane. The various features can be mixed-and-matched, as may be appropriate.

Various embodiments of the invention have been described in detail. Since changes in and or additions to the above-described best mode may be made without departing from the nature, spirit or scope of the invention, the invention is not to be limited to those details but only by the appended claims.

I claim:

1. A veneer masonry support assembly comprising:

a first support bracket, a second support bracket, and a shelf angle;

said first and second support brackets having rearward facing fittings by which to mount them to a supporting wall structure;

said first and second support brackets having respective forward facing seats in which to receive said shelf angle;

said shelf angle having a length to span said first and second support brackets;

said shelf angle having a horizontal leg that defines a shelf upon which to mount masonry veneer, and a vertical leg that engages said respective forward facing seats of said first and second support brackets;

when said shelf angle is mounted to said first and second support brackets said vertical leg of said shelf angle is spaced forwardly from the supporting wall structure by a spacing distance;

a masonry veneer support hanger assembly having a first member and a second member, said second member being removably attachable to said first member;

said first member defining a hook; said hook being operable to grapple said vertical leg of a masonry veneer shelf angle;

said hook fitting behind said shelf angle in said spacing distance;

said first member defining a first mounting interface;

said second member defining a second mounting interface;

said second member having a foot, said foot being profiled to conform to a masonry veneer;

said first mounting interface and said second mounting interface being mutually engageable; and said foot having at least one accommodation formed there through to admit the passage therethrough of re-bar and to accommodate mortar.

2. The veneer masonry mounting assembly of claim 1 wherein said first member includes a first portion, a second portion and a third portion; said first portion defining a downwardly hanging tab that includes said first mounting interface and forming a root of said hook; said second portion defining an arm that forms a reach of said hook; said third portion defining a downwardly extending finger; said finger forming a tip of said hook.

3. The veneer masonry mounting assembly of claim 2 wherein, as installed, said root of said hook lies behind the vertical leg of said shelf angle and stands outwardly rearwardly away therefrom; said reach extends over the vertical leg and stands in a plane upwardly away therefrom; and said finger extends downwardly forwardly of the vertical leg of the shelf angle.

4. The veneer masonry mounting assembly of claim 3 wherein said root, said reach, and said finger define a crotch, and, when a veneer masonry load is mounted to said second member the vertical leg of the shelf angle seats in the crotch; and said finger and said root are parallel and spaced apart to form a slot of width corresponding to the vertical leg of the shelf angle.

5. The veneer masonry mounting assembly of claim 2 wherein said first portion, second portion and third portion are formed from a single piece of sheet metal; and said third portion of said first member is bent out of plane to form a tab that, as installed, stands in planar opposition to a forward face of the vertical leg of the shelf angle between said vertical leg and the masonry veneer, and, as installed, said tab is free of fastenings to the shelf angle.

6. The veneer masonry mounting assembly of claim 1 wherein said second member is planar; said foot underlies a horizontal leg of the shelf angle; said foot has a toe and a heel; and said toe extends forwardly under the shelf angle.

7. The veneer masonry mounting assembly of claim 6 wherein said second member has an upwardly extending stem that mates with said tab of said first member behind the shelf angle.

8. The veneer masonry assembly of claim 1 wherein:

as installed, said first member is located in engagement with said vertical leg of said shelf angle between said first and second support brackets;

said first member includes a first portion, a second portion and a third portion formed from a sheet metal blank;

said first portion defines a downwardly hanging tab that includes said first mounting interface and forms a root of said hook;

said second portion defines an arm that forms a reach of said hook;

said third portion defines a downwardly extending finger;

said finger forms a tip of said hook;

as installed, said root of said hook lies behind the vertical leg of said shelf angle;

said reach extends over the vertical leg; and said finger extends downwardly forwardly of the vertical leg of the shelf angle;

between said shelf angle and the masonry veneer;

said finger and said root are parallel and spaced apart to form a slot of width corresponding to the vertical leg of the shelf angle;

said hook is bent out-of-plane relative to said reach to present a flat tab in opposition to a forward face of the vertical leg of the shelf angle; and said second member is planar, and has an upwardly extending stem that mates with said tab of said first member behind the shelf angle; and at least part of said foot extends forwardly under the shelf angle.

9. The masonry veneer support assembly of claim 1 wherein there are a first and a second of said masonry veneer support hanger assemblies mounted to said shelf angle, and a course of bricks is mounted to said first and second masonry veneer support hanger assemblies, said course of bricks extending beneath said horizontal leg of said shelf angle.

10. The veneer masonry mounting assembly of claim 2 wherein, as installed, said root of said hook lies behind the vertical leg of said shelf angle; said reach extends over the vertical leg; and said finger extends downwardly forwardly of the vertical leg of the shelf angle.

11. The veneer masonry mounting assembly of claim 10 wherein said root, said reach, and said finger define a crotch, and, when a veneer masonry load is mounted to said second member the vertical leg of the shelf angle seats in the crotch.

12. The veneer masonry mounting assembly of claim 2 wherein said finger and said root are parallel and spaced apart to form a slot of width corresponding to the vertical leg of the shelf angle.

13. The veneer masonry mounting assembly of claim 1 wherein said second member of said masonry support hanger assembly is planar.

14. The veneer masonry mounting assembly of claim 13 wherein said foot underlies a horizontal leg of the shelf angle; said foot has a toe and a heel; said toe extends forwardly under the shelf angle and said heel extends rearwardly thereof, and said toe is longer than said heel.

15. The veneer masonry mounting assembly of claim 13 wherein said second member has an upwardly extending stem that mates with said tab of said first member behind the shelf angle.

16. The veneer masonry mounting assembly of claim 15 wherein said foot is asymmetric relative to said upwardly extending stem.

* * * * *